US006504116B2

(12) United States Patent
Nishikawa

(10) Patent No.: US 6,504,116 B2
(45) Date of Patent: Jan. 7, 2003

(54) SWITCH

(75) Inventor: Kikuyoshi Nishikawa, Yokohama (JP)

(73) Assignee: Sagami Electric Co., Ltd., Kanagawa (JP)

( * ) Notice: Subject to any disclaimer, the term of this patent is extended or adjusted under 35 U.S.C. 154(b) by 0 days.

(21) Appl. No.: 09/972,427

(22) Filed: Oct. 4, 2001

(65) Prior Publication Data

US 2002/0050447 A1 May 2, 2002

(30) Foreign Application Priority Data

Oct. 5, 2000 (JP) ..... 2000-306008

(51) Int. Cl.[7] ..... H01H 21/80; H01H 1/26

(52) U.S. Cl. ..... 200/6 B; 200/1 B; 200/16 D; 200/402; 200/437; 200/558; 200/559

(58) Field of Search ..... 200/6 R–6 C, 200/16 R–16 D, 402, 405, 431, 434, 437–439, 449, 553, 557–559, 561, 335, 339, 1 B

(56) References Cited

U.S. PATENT DOCUMENTS 4,967,043 A * 10/1990 Killarney ..... 200/1 B
4,978,823 A * 12/1990 Sato et al. ..... 200/339
5,498,846 A * 3/1996 Chin ..... 200/553
5,601,183 A * 2/1997 Boyd et al. ..... 200/339
5,769,209 A * 6/1998 Massey, III ..... 200/330

* cited by examiner

*Primary Examiner*—Michael Friedhofer
(74) *Attorney, Agent, or Firm*—David N. Lathrop, Esq.; Gallagher & Lathrop

(57) ABSTRACT

A switch having a long contact life is provided. A neutral contact blade is provided with a first neutral contact and a second neutral contact. A primary movable contact blade and a secondary movable contact blade are supported by these first and second neutral contacts, respectively, for seesaw motion. The operation of a lever causes the primary movable contact blade and the secondary movable contact blade through a pushrod to move in a seesaw motion in such a manner that a secondary movable contact provided on one end of the secondary movable contact blade contacts with an associated secondary fixed contact before a primary movable contact provided on one end of the primary movable contact blade contacts with an associated primary fixed contact, whereas after the primary movable contact of the primary movable contact blade is separated from the primary fixed contact, the secondary movable contact of the secondary movable contact blade is separated from the secondary fixed contact. This construction causes flow of a large closing current and any arc discharge to occur mainly on the side of the secondary movable contact blade.

6 Claims, 12 Drawing Sheets

SWITCH

BACKGROUND OF THE INVENTION

1. Field of the Invention

The present invention relates to a switch configured such that a movable contact blade is moved through a seesaw motion by a lever operation thereby to close and open the contacts of the switch.

2. Description of the Related Art

Various types of switches such as a toggle switch, for example, are in practical use in which switch contacts are turned on and off instantly through a snap action by the on/off operation of a spring-loaded lever. An example of the prior art switch of this type will be described with reference to FIGS. 10 and 11.

FIG. 10 is a diagrammatical sectional view illustrating the general construction of the prior art switch. The switch 23 comprises a generally rectangular box 11 having an open top; a neutral contact blade 12 fixed to the internal bottom surface of the box 11 generally in the center thereof; a fixed contact blade 13 fixed to the internal bottom surface of the box 11 adjacent to one end portion (left-hand end as viewed in FIG. 10) thereof; a movable contact blade 15 supported for seesaw motion by a neutral contact 12*b* vertically upstanding from one side edge of the neutral contact blade 12; a movable contact 16 affixed to the undersurface of the movable contact blade 15 adjacent its forward end thereof, the movable contact 16 being adapted to come into electrically and mechanically contact with a fixed contact 14 secured to the fixed contact blade 13 when the switch is turned on and to move away from the fixed contact 14 when the switch is turned off, a frame 17 covering the open top of the rectangular box 11; a sleeve 18 secured by crimping to the periphery of an opening 17*a* formed through the frame 17 in the center thereof; a lever 19 having a generally spherical one end portion 19*b* housed in the sleeve 18 and having the opposite end portion projecting out through a tapered opening 18*a* formed in the sleeve 18; a coil spring 21 accommodated in an axially extending housing bore 19*a* formed in the generally spherical one end portion (which will be referred to as inner end portion hereinafter) 19*b* of the lever 19; and a pushrod (or actuator) 22 having a shaft portion 22*a* housed in the housing or storage bore 19*a* and a tip portion 22*b*, the shaft portion 22*a* being resiliently urged by the coil spring 21 in such a sense as to be extended from the housing bore 19*a* to urge the tip portion 22*b* against the face of the strip-like body 15*c* of the movable contact blade 15.

The generally spherical inner end portion 19*b* of the lever 19 is greater in diameter than the tapered opening 18*a* in the sleeve 18 so that the lever 19 is prevented from withdrawing from the sleeve 18. In addition, the generally spherical inner end portion 19*b* of the lever 19, the tapered opening 18*a* in the sleeve 18, the coil spring 21, the pushrod 22 and the movable contact blade 15 are configured so as to cooperate to allow the instantaneous throw-up or throw-down (turning on/off) operation of the lever 19.

Further, it is to be noted that the neutral contact blade 12 and the fixed contact blade 13 have integral terminals 12*a* and 13*a*, respectively, depending from the respective strip-like bodies, the terminals 12*a* and 13*a* extending out through the bottom wall of the box 11.

FIG. 11 shows the neutral contact blade 12, the fixed contact blade 13 and the movable contact blade 15 in a perspective view as removed from the switch shown in FIG. 10. The neutral contact blade 12 comprises a strip-like body 12c secured to the bottom surface of the box 11, a terminal 12*a* depending from the body at one end thereof, and a generally U-shaped (channel-shaped) neutral contact 12*b* upstanding from one longitudinal side edge of the body and having a cutout formed in its upper end in the center thereof to define two protrusions 12*b*1 and 12*b*2. The fixed contact blade 13 comprises a strip-like body 13*c* secured to the bottom surface of the box 11, a terminal 13*a* depending from the body at one end thereof, and a fixed contact 14 affixed to the face of the body generally in the center thereof. The movable contact blade 15 comprises a strip-like body 15*c*, a folded portion 15*a* depending from the body at one end thereof, a support portion 15*b* including two opposed pairs of protrusions 15*d*1 and 15*d*2 extending perpendicularly and generally horizontally from the opposite longitudinal side edges of the body generally in the center thereof, and a movable contact 16 affixed to the undersurface of the body adjacent the other end thereof.

The width of the strip-like body 15*c* of the movable contact blade 15 is approximately equal to the length of the cutout portion of the U-shaped neutral contact 12*b* of the neutral contact blade 12, so that when assembled, the strip-like body 15*c* of the movable contact blade 15 is fitted in the cutout portion of the U-shaped neutral contact 12*b* with the opposite protrusions 12*b*1 and 12*b*2 engaged between the respective pairs of protrusions 15*d*1 and 15*d*2 of the support portion 15*b*, as shown in FIG. 10, whereby the movable contact blade 15 is positioned and supported by the neutral contact 12*b* of the neutral contact blade 12 for seesaw motion about the neutral contact.

While the fixed contact 14 and the movable contact 16 are typically formed of silver, they may of course be made of good electrically conductive metal such as gold. It is also to be noted that in this example the frame 17 is secured by crimping to the box 11 and that the neutral contact blade 12 and the fixed contact blade 13 are secured to the box 11 by twisting the root portions of the respective terminals 12*a* and 13*a*.

With the switch 23 constructed as described above, it will be apparent that the throw-up and throw-down operation of the lever 19 causes the sliding movement of the tip 22*b* of the pushrod 22 on and along the strip-like body 15*c* of the movable contact blade 15 concomitant with the seesaw motion of the movable contact blade 15 so that the movable contact 16 comes into contact with the fixed contact 14 and goes away from the fixed contact 14. The operation will be described in more details with reference to FIG. 12.

FIG. 12 illustrates in diagrammatical sectional views how the movable contact 16 is moved into electrical and mechanical contact with the fixed contact 14 by the operation of the lever 19. First, as the lever 19 is maneuvered in the direction indicated by an arrow 24 (clockwise as viewed in the drawing) from the switch-off position shown in FIG. 12A, the movable contact 16 is maintained to be disconnected from the fixed contact 14 as shown in FIG. 12B until the tip 22*b* of the pushrod 22 passes over the neutral contact 12*b*. The instant that the tip 22*b* of the pushrod 22 has passed over the neutral contact 12*b*, the movable contact blade 15 is rapidly moved in a seesawing manner about the neutral contact 12*b* as its fulcrum in the sense to bring the movable contact 16 into contact with the fixed contact 14 under the resilient force of the coil spring 21 and concurrently the lever 19 is rapidly moved (moved by snap action) to the position shown in FIG. 12C. It is thus to be appreciated that the movable contact 16 and the fixed contact 14 are firmly contacted with each other both electrically and mechanically to turn the switch on.

Conversely, as the lever 19 is maneuvered in the counterclockwise direction as viewed in the drawing from the switch-on position shown in FIG. 12C, the movable contact 16 is maintained to be in contact with the fixed contact 14 until the tip 22*b* of the pushrod 22 passes over the neutral contact 12*b*. The instant that the tip 22*b* of the pushrod 22 has passed over the neutral contact 12*b*, the movable contact blade 15 is rapidly moved in a seesawing manner about the neutral contact 12*b* as its fulcrum under the resilient force of the coil spring 21 in the sense to move the movable contact 16 out of contact with the fixed contact 14 and concurrently the lever 19 is rapidly moved (moved by snap action) to the position shown in FIG. 12A. In this way, the movable contact 16 and the fixed contact 14 are separated from each other to turn the switch off.

As is appreciated from the foregoing, the switch 23 constructed as described above is configured such that the rapid seesaw motion (snap action) of the lever 19 is effected by the extension and contraction of the coil spring 21 accommodated in the housing bore 19*a* in the lever 19. In other words, the arrangement is such that the quick closing and opening action of the contacts is effected irrespective of the speed at which the lever 19 is manually maneuvered.

In this regard, it should be noted that the closing and opening action is attended with such phenomena that the instant the movable contact 16 and the fixed contact 14 are brought into contact (the instant the switch is turned on), there usually flows momentarily a closing current greater than a predetermined current and that the instant the movable contact 16 and the fixed contact 14 are separated from each other (the instant the switch is turned off), there usually occurs an arc discharge. Consequently, the contacts (movable contact 16 and fixed contact 14) of this type of switch may possibly be subject to thermal deformation due to abnormal heating caused by such closing current, and further, may possibly be subject to damage by such arc discharge. For this reason, the prior art switch had the serious drawback that the contact life tended to be shortened by the closing current and the arc discharge.

SUMMARY OF THE INVENTION

It is an object of the present invention to provide a switch that has an increased contact life and superior durability.

It is another object of the present invention to provide a switch having a long contact life, which is configured to prevent a large closing current from flowing when the contacts are closed as well as to suppress an arc discharge occurring when the contacts are opened to a minimum.

In order to accomplish the foregoing objects, in one aspect of the present invention, there is provided a switch which comprises: a neutral contact blade provided with a first neutral contact and a second neutral contact; a fixed contact blade provided with a primary fixed contact and a secondary fixed contact; a primary movable contact blade supported by the first neutral contact for seesaw motion about the first neutral contact as its fulcrum and provided at one end thereof with a primary movable contact adapted to contact with and separate from the primary fixed contact; a secondary movable contact blade supported by the second neutral contact for seesaw motion about the second neutral contact as its fulcrum and provided at one end thereof with a secondary movable contact adapted to contact with and separate from the secondary fixed contact; and a pushrod integrated with a lever and adapted to slide on the primary movable contact blade and on the secondary movable contact blade on the basis of throw-up and throw-down operation of the lever to cause the primary and the secondary movable contact blades to move in a seesaw motion; whereby the secondary movable contact contacts with the secondary fixed contact before the primary movable contact contacts with the primary fixed contact, and the secondary movable contact is separated from the secondary fixed contact after the primary movable contact is separated from the primary fixed contact.

In a preferred embodiment, the primary movable contact blade comprises: a strip-like body; a folded portion depending from the body at one end thereof; a support portion including two opposed pairs of protrusions extending perpendicularly and generally horizontally from the opposite longitudinal side edges of the body generally in the center thereof; and a primary movable contact affixed to the undersurface of the body adjacent to the other end thereof, and the secondary movable contact blade comprises: a strip-like body; a folded portion depending from the body at one end thereof; a support portion including two opposed pairs of protrusions extending perpendicularly and generally horizontally from the opposite longitudinal side edges of the body toward the folded portion; and a secondary movable contact affixed to the undersurface of the body adjacent to the other end thereof; the support portion of the secondary movable contact blade being located closer to the folded portion by a distance approximately equal to the width of the body of the neutral contact blade than the support portion of the primary movable contact blade is; and the primary movable contact blade and the secondary movable contact blade being disposed in parallel with each other and supported by the first neutral contact and the second neutral contact, respectively, for seesaw motion thereabout.

In another preferred embodiment, the primary movable contact blade includes a pair of blade-like supports adapted to nip therebetween the first neutral contact and a pair of blade-like primary movable contacts adapted to nip therebetween the primary fixed contact.

Preferably, the secondary movable contact and the secondary fixed contact are formed of silver-tungsten.

With the construction as described above, the secondary movable contact of the secondary movable contact blade first contacts with the secondary fixed contact of the fixed contact blade before the primary movable contact of the primary movable contact blade contacts with the primary fixed contact of the fixed contact blade, and after the primary movable contact of the primary movable contact blade is first disconnected from the primary fixed contact of the fixed contact blade, the secondary movable contact of the secondary movable contact blade is disconnected from the secondary fixed contact of the fixed contact blade. It will thus be appreciated that both of any large closing current flow associated with the switch-on operation and any arc discharge associated with the switch-off operation may occur mainly between the secondary movable contact of the secondary movable contact blade and the secondary fixed contact blade.

BRIEF DESCRIPTION OF THE DRAWINGS

FIG. 1 shows the external appearance of a first embodiment of the switch according to the present invention; FIG. 1A being a front view thereof while

FIG. 5 shows the construction of the pushrod of the switch shown in FIGS. 2 and 3; FIG. 5A is an exploded front view, partly in section, thereof while

DETAILED DESCRIPTION OF THE PREFERRED EMBODIMENTS

The preferred embodiments of the present invention will now be described in detail with reference to FIGS. 1 to 9. The present invention may, however, be embodied in many different forms and should not be construed as limited to the embodiments set forth hereinafter; rather, the embodiments are provided so that this disclosure will be thorough and complete, and will fully convey the scope of the invention to those skilled in the art.

Figure 1A:
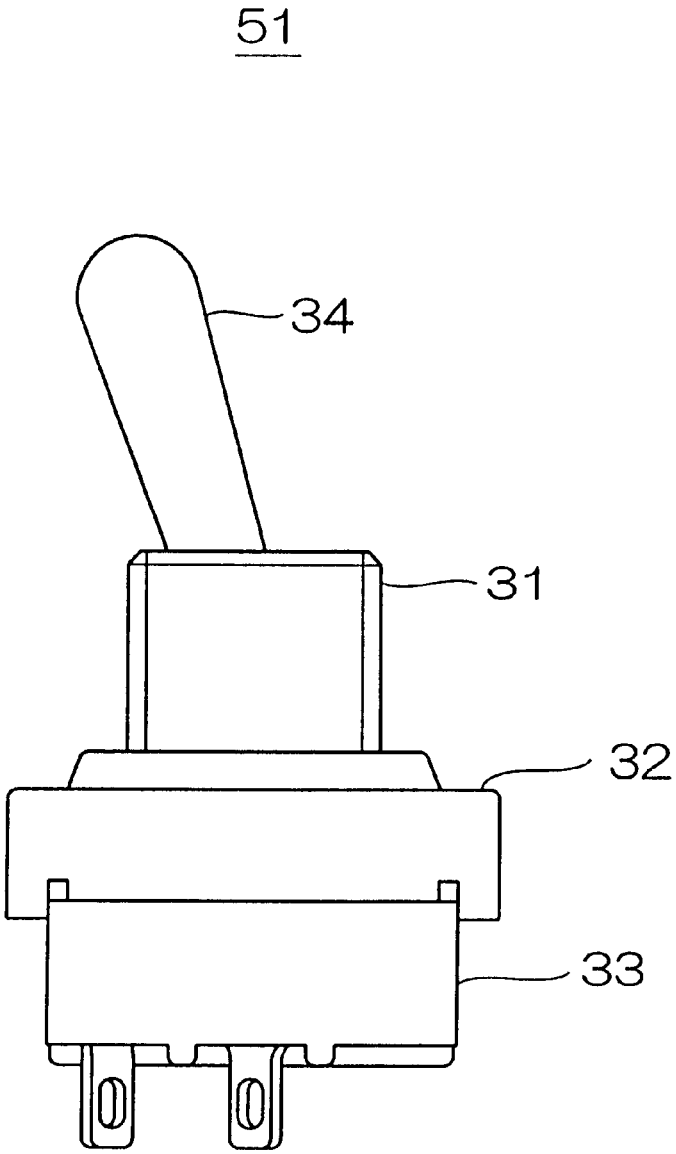
Figure 1B:
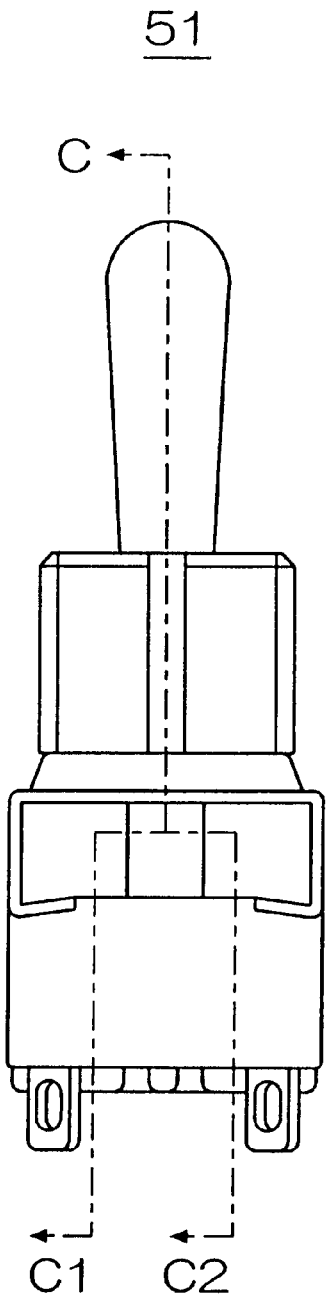
FIG. 1B is a left side view of FIG. 1A.

FIG. 1 shows the external appearance of a first embodiment of the switch according to the present invention, FIG. 1A is a front view thereof and FIG. 1B is a left side view of FIG. 1A. As is the case with the prior art switch 23 shown in FIG. 10, the switch 51 of the first embodiment comprises a generally rectangular box 33 having an open top for housing the components of the switch which will be described below; a frame 32 covering the open top of the rectangular box 33; a sleeve 31 secured to the periphery of an opening 32*a* formed through the frame 32 in the center thereof; and a lever 34 projecting out through a tapered opening 31*a* formed in the sleeve 31.

Figure 2:
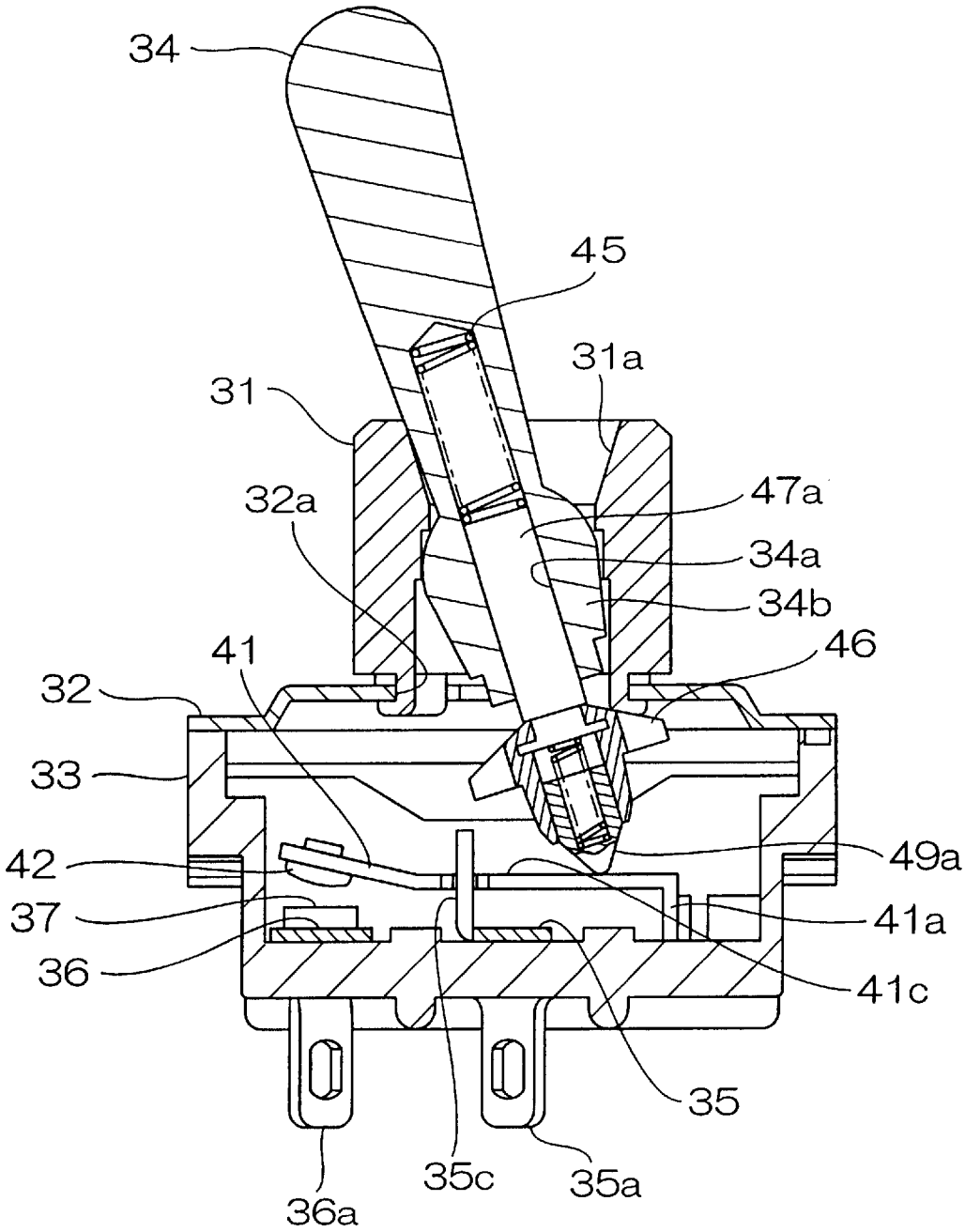
FIG. 2 is a sectional view taken along the line C-C1 in FIG. 1B and looking in the direction indicated by the arrows.
Figure 3:
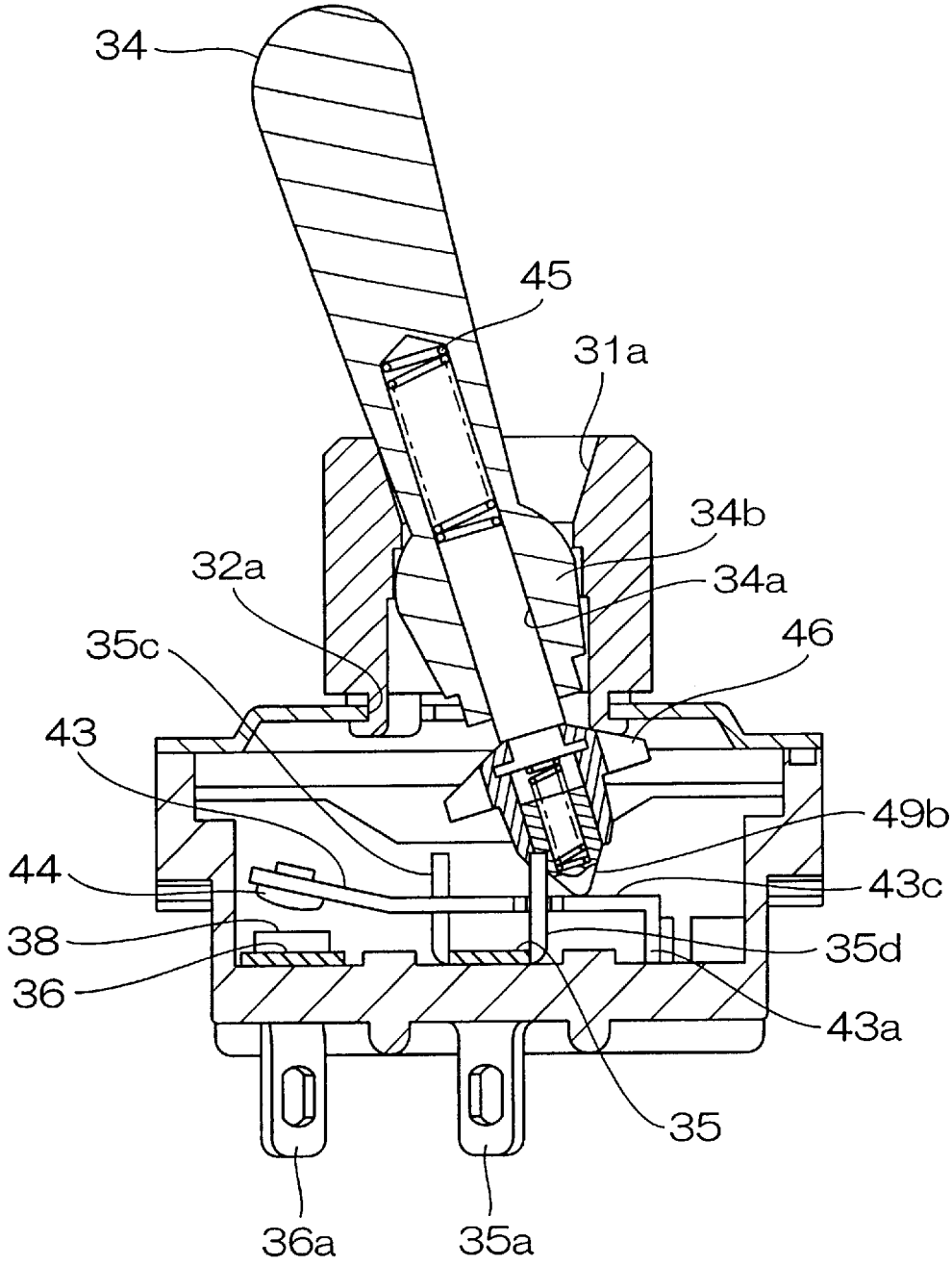
FIG. 3 is a sectional view taken along the line C-C2 in FIG. 1B and looking in the direction indicated by the arrows.

FIG. 2 is a sectional view taken along the line C-C1 and looking in the direction indicated by the arrows and FIG. 3 is a sectional view taken along the line C-C2 and looking in the direction indicated by the arrows. First, referring to FIGS. 2, 3 and 4, the construction of the switch 51 of the first embodiment according to the present invention will be described in details.

The switch 51, as shown in FIGS. 2 and 3, comprises a generally rectangular box 33 having an open top; a neutral contact blade 35 fixed to the internal bottom surface of the box 33 generally in the center thereof; a fixed contact blade 36 fixed to the internal bottom surface of the box 33 adjacent to one end portion (left-hand end as viewed in FIGS. 2 and 3) thereof and having a primary fixed contact 37 and a secondary fixed contact 38 affixed at a predetermined spacing thereto; a primary movable contact blade 41 supported for seesaw motion by a first neutral contact 35*c* vertically upstanding from one side edge of the neutral contact blade 35; a primary movable contact 42 affixed to the undersurface of the primary movable contact blade 41 adjacent its forward end thereof and adapted to contact with the primary fixed contact 37 when the switch is turned on; a secondary movable contact blade 43 supported for seesaw motion by a second neutral contact 35*d* vertically upstanding from the other side edge of the neutral contact blade 35 and positioned in parallel with the primary movable contact blade 41; a secondary movable contact 44 affixed to the undersurface of the secondary movable contact blade 43 adjacent its forward end thereof and adapted to contact with the secondary fixed contact 38 when the switch is turned on; a frame 32 covering the open top of the rectangular box 33; a sleeve 31 secured by crimping in this example to the periphery of an opening 32*a* formed through the frame 32 in the center thereof; a lever 34 having a generally spherical one end portion 34*b* housed in the sleeve 31 and having the opposite end portion projecting out through a tapered opening 31*a* formed in the sleeve 31; a coil spring 45 accommodated in an axially extending storage bore 34*a* formed in the generally spherical one end portion (which will be referred to as inner end portion hereinafter) 34*b* of the lever 34; and a pushrod (or actuator) 46 having a shaft portion 47*a* housed in the storage bore 34*a*, the shaft portion 47*a* being resiliently urged by the coil spring 45 in such a sense as to be extended from the storage bore 34*a*.

Figure 10:
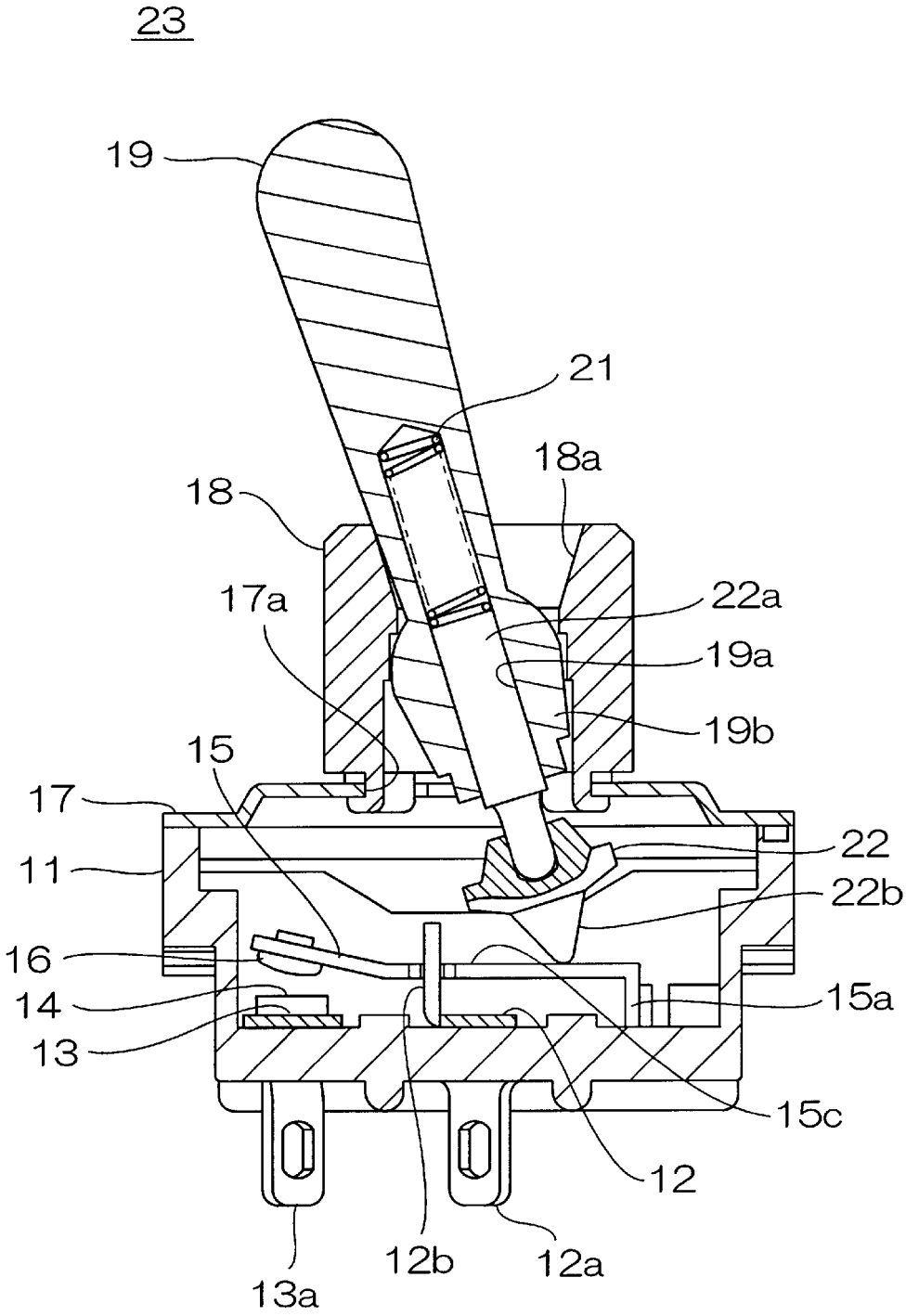
FIG.10 PRIOR ART
FIG. 10 is a diagrammatical sectional view illustrating the construction of the principal parts of an example of the prior art switch.
Figure 11:
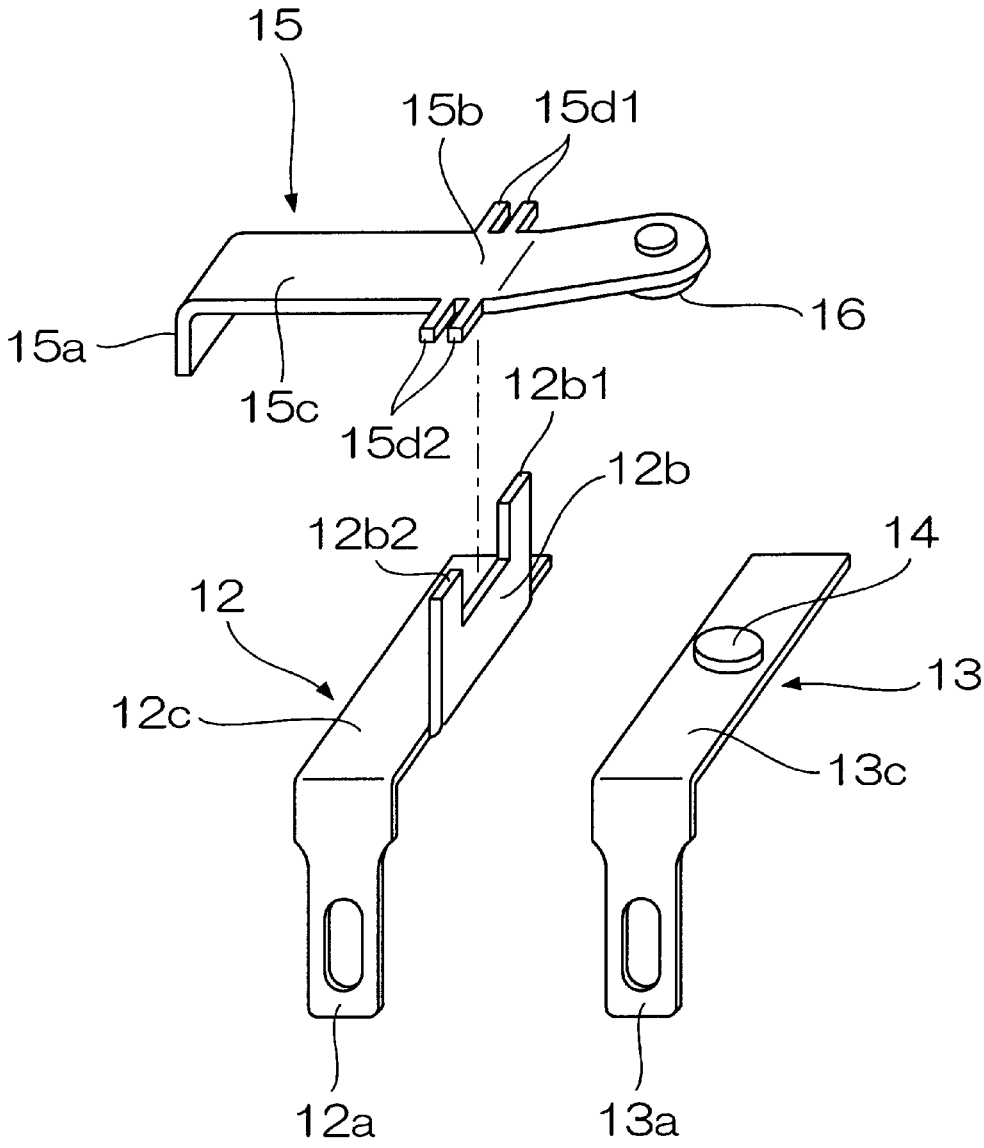
FIG.11 PRIOR ART
FIG. 11 is an exploded perspective view of the movable contact blade, the neutral contact blade and the fixed contact blade as removed from the switch shown in FIG. 10.
Figure 12A:
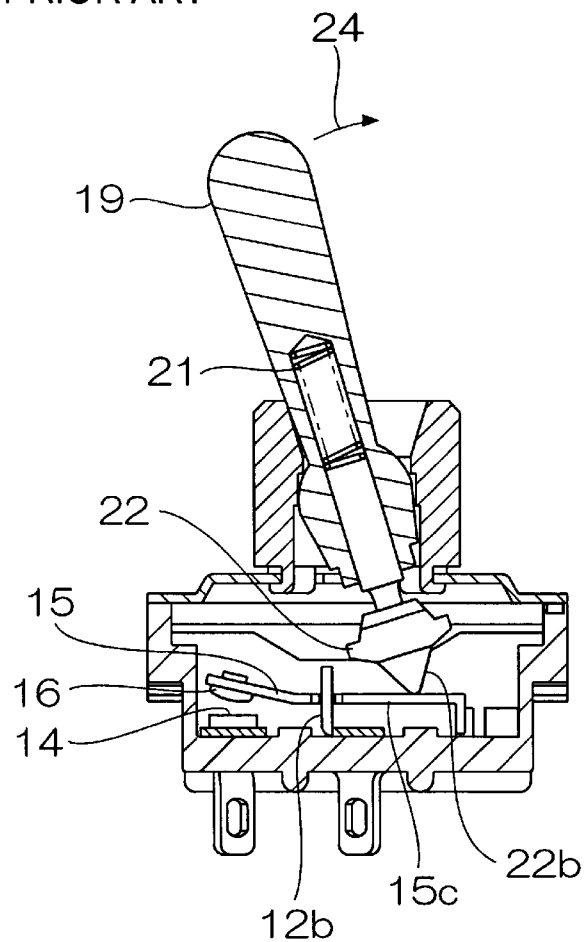
FIG.12A PRIOR ART
FIG. 12 is a diagrammatical sectional view illustrating the operation of the switch shown in FIG. 10.
Figure 12B:
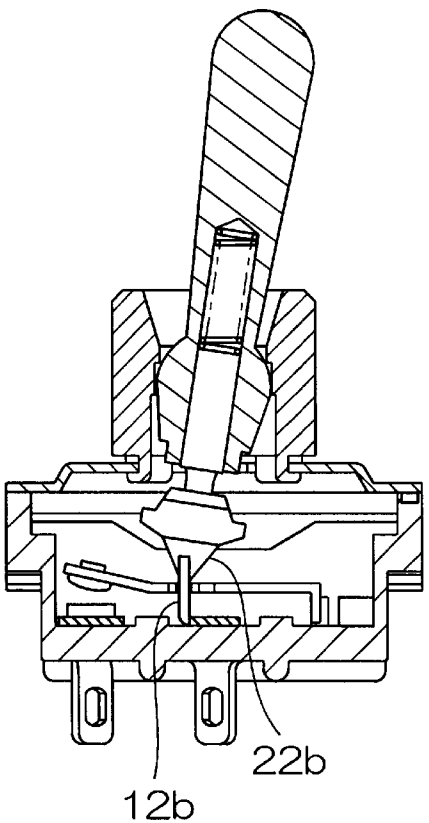
FIG.12B PRIOR ART
Figure 12C:
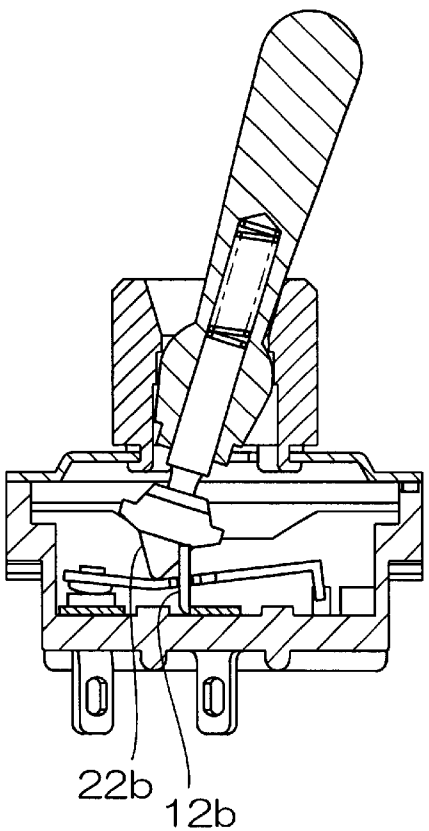
FIG.12C PRIOR ART

The generally spherical inner end portion 34*b* of the lever 34 is greater in diameter than the tapered opening 31*a* in the sleeve 31 so that the lever 34 is prevented from withdrawing from the sleeve 31. It is to be understood that the frame 32, sleeve 31 and lever 34 may be of the configuration similar to that of the frame 17, sleeve 18 and lever 19 of the prior art as shown in FIG. 10.

Figure 4:
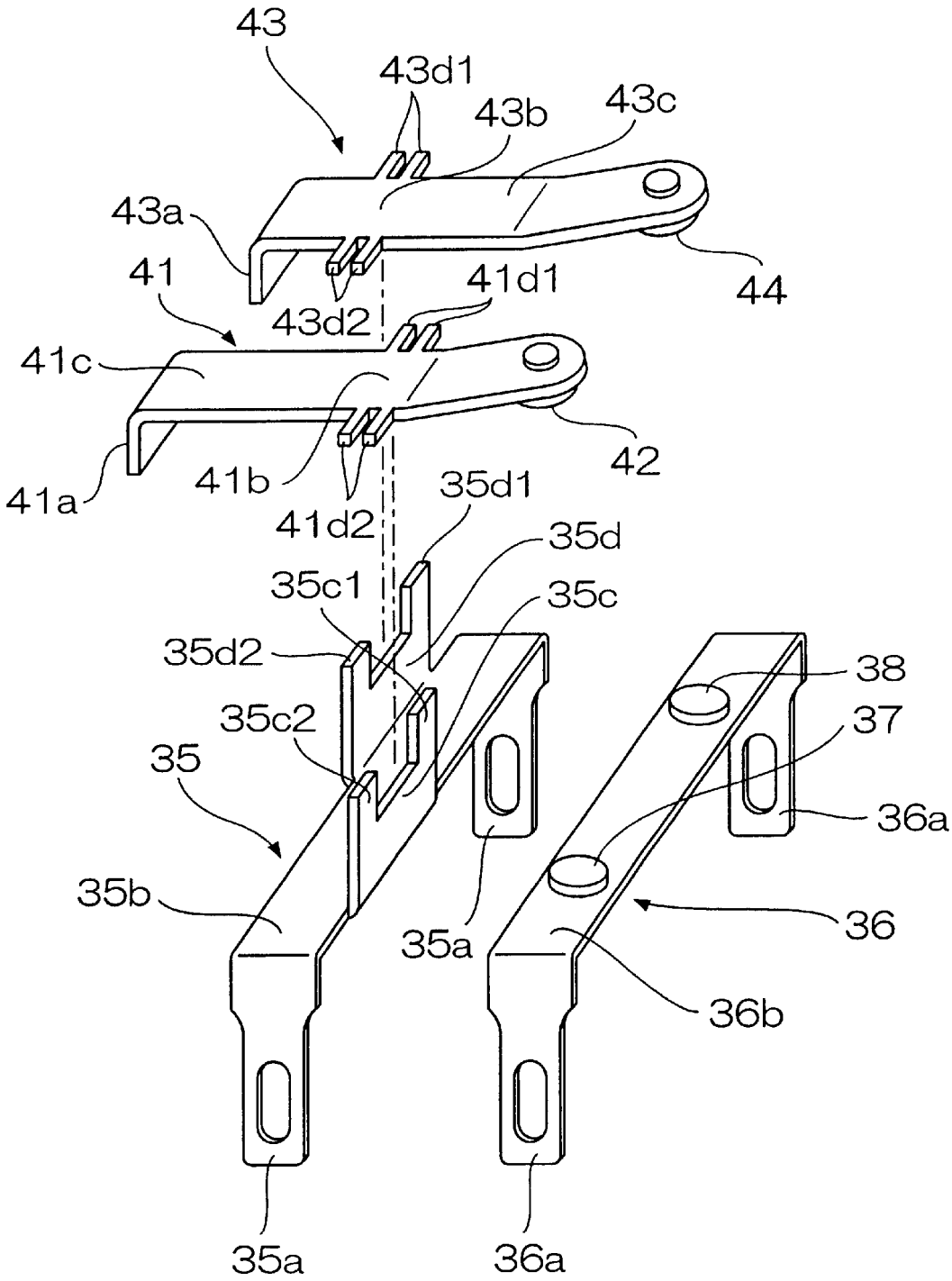
FIG. 4 is an exploded perspective view of the primary movable contact blade, the secondary movable contact blade, the neutral contact blade and the fixed contact blade as removed from the switch shown in FIGS. 2 and 3.

As is seen from FIG. 4, the first neutral contact 35*c* vertically upstanding from one side edge of the neutral contact blade 35 and the second neutral contact 35*d* vertically upstanding from the other side edge extend from the opposite side edges at locations not opposed, that is, staggered with respect to the length of the strip-like body 35*b* of the neutral contact blade 35. More specifically, the first neutral contact 35*c* and the second neutral contact 35*d* are formed so as to vertically stand erect from the opposite side edges at a predetermined spacing with respect to the longitudinal of the strip-like body 35*b* (such that the primary movable contact blade 41 and the secondary movable contact blade 43 do not interfere with each other when they are disposed in parallel). It will thus be appreciated that the primary movable contact blade 41 and the secondary movable contact blade 43 are supported for seesaw motion by the first neutral contact 35*c* and the second neutral contact 35*d*, respectively, and are positioned in parallel with each other.

As will be described in details hereinafter with reference to FIG. 5, the pushrod 46 has a first thrust piece 49*a* and a second thrust piece 49*b* in a pair mounted thereon at its lower end, the first and second thrust pieces 49*a*, 49*b* being spaced apart by a predetermined distance so as to ride on the surfaces, respectively, of the strip-like bodies 41*c* and 43*c* of the primary movable contact blade 41 and the secondary movable contact blade 43 disposed in parallel. In this embodiment, the first thrust piece 49*a* is in urged contact with the surface of the strip-like body 41*c* of the primary movable contact blade 41 for sliding movement longitudinally of the strip-like body 41*c*, and likewise the second thrust piece 49*b* is in urged contact with the surface of the strip-like body 43*c* of the secondary movable contact blade 43 for sliding movement longitudinally of the strip-like body 43*c*.

FIG. 4 is an exploded perspective view of the primary movable contact blade 41, the secondary movable contact blade 43, the neutral contact blade 35 and the fixed contact blade 36 of the switch 51 shown in FIGS. 2 and 3 as removed from the switch. The neutral contact blade 35 comprises a strip-like body 35*b* secured to the bottom surface of the box 33 generally in the center thereof and extending perpendicularly to the primary movable contact blade 41 and the secondary movable contact blade 43, terminals 35*a*, 35*a* depending from the strip-like body at opposite ends thereof, a generally U-shaped (channel-shaped) first neutral contact 35*c* upstanding from one longitudinal side edge of the body 35*b* and having a cutout formed in its upper end in the center thereof to define two protrusions 35*c*1 and 35*c*2, and a generally U-shaped (channel-shaped) second neutral contact 35*d* upstanding from the other longitudinal side edge of the body 35*b* at a location not overlapping with the first neutral contact 35*c* and having a cutout formed in its upper end in the center thereof to define two protrusions 35*d*1 and 35*d*2. Further, it is preferred that the first neutral contact 35*c* and the second neutral contact 35*d* be formed at locations symmetrical about the center of the strip-like body 35*b* and such that they do not overlap with each other with respect to the width of the strip-like body 35*b*.

The fixed contact blade 36 comprises a strip-like body 36*b* secured to the internal bottom surface of the box 33 adjacent to one end portion (left-hand end as viewed in FIGS. 2 and 3) thereof and extending perpendicularly to the primary movable contact blade 41 and the secondary movable contact blade 43, terminals 36*a* and 36*a* depending from the body 36*b* at the opposite ends thereof, and the primary fixed contact 37 and the secondary fixed contact 38 affixed to the surface of the body 36*b* spaced apart by a predetermined distance longitudinally thereof. The spacing between the primary fixed contact 37 and the secondary fixed contact 38 is set to be substantially equal to the spacing between the primary movable contact 42 of the primary movable contact blade 41 and the secondary movable contact 44 of the secondary movable contact blade 43.

The primary movable contact blade 41 comprises a strip-like body 41*c*, a folded portion 41*a* depending from the body 41*c* at one end thereof, a support portion 41*b* including two opposed pairs of protrusions 41*d*1 and 41*d*2 extending perpendicularly and generally horizontally from the opposite longitudinal side edges of the body 41*c* generally in the center of the body, and the primary movable contact 41 affixed to the undersurface of the body 41*c* adjacent to the other end thereof. Similarly, the secondary movable contact blade 43 comprises a strip-like body 43*c*, a folded portion 43*a* depending from the body 43*c* at one end thereof, a support portion 43*b* including two opposed pairs of protrusions 43*d*1 and 43*d*2 extending perpendicularly and generally horizontally from the opposite longitudinal side edges of the body 43*c* toward the folded portion 43*a*, and the secondary movable contact 44 affixed to the undersurface of the body 43*c* adjacent to the other end thereof. It is to be understood that the support portion 43*b* of the secondary movable contact blade 43 is located closer to the folded portion 43*a* by a distance approximately equal to the width of the body 35*b* of the neutral contact blade 35 than the support portion 41*b* of the primary movable contact blade 41 is.

The width of the strip-like body 41*c* of the primary movable contact blade 41 and the width of the strip-like body 43*c* of the secondary movable contact blade 43 are approximately equal to the length of the cutout portions of the U-shaped first and second neutral contacts 35*c* and 35*d*, respectively, of the neutral contact blade 35, so that when assembled as shown in FIGS. 2 and 3, the strip-like body 41*c* of the primary movable contact blade 41 is fitted in the cutout portion of the first neutral contact 35*c* with the opposite protrusions 35*c*1 and 35*c*2 of the neutral contact 35*c* engaged between the respective pairs of protrusions 41*d*1 and 41*d*2 of the support portion 41*b*. Likewise, the strip-like body 43*c* of the secondary movable contact blade 43 is fitted in the cutout portion of the U-shaped second neutral contact 35*d* with the opposite protrusions 35*d*1 and 35*d*2 of the neutral contact 35*d* engaged between the respective pairs of protrusions 43*d*1 and 43*d*2 of the support portion 43*b*. It will thus be appreciated that the primary movable contact blade 41 is positioned and supported by the first neutral contact 35*c* of the neutral contact blade 35 for seesaw motion about the neutral contact 35*c* as its fulcrum while the secondary movable contact blade 43 is positioned and supported by the second neutral contact 35*d* of the neutral contact blade 35 for seesaw motion about the neutral contact 35*d* as its fulcrum.

It is also to be noted that the terminals 35*a* and 36*a* depending from the opposite ends of the respective strip-like bodies 35*b* and 36*b* of the neutral contact blade 35 and the fixed contact blade 36 extend out through the bottom wall of the box 33 and are crimped to the box 33 by twisting the root portions of the respective terminals 35*a* and 36*a* in this embodiment to thereby secure the neutral contact blade 35 and the fixed contact blade 36 to the box 33.

While in this embodiment the primary movable contact blade 41 and the secondary movable contact blade 43 are of the same size and configuration except the difference in the locations of the support portions 41*b* and 43*b*, the dimensions and/or shapes may be varied as required.

Figure 5A:
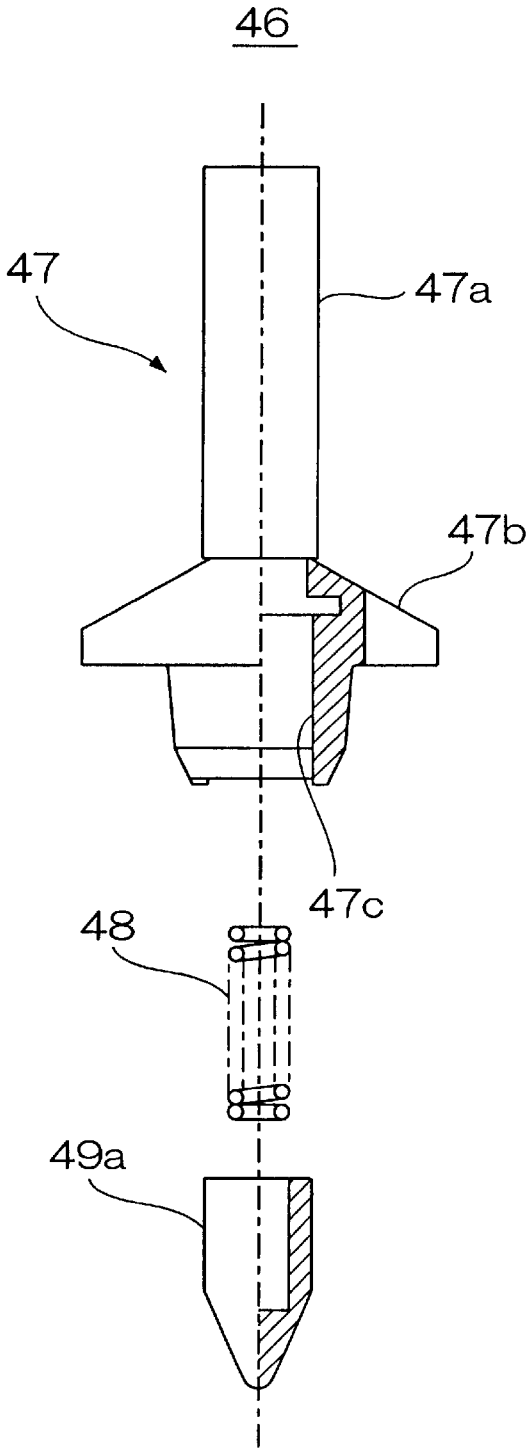
Figure 5B:
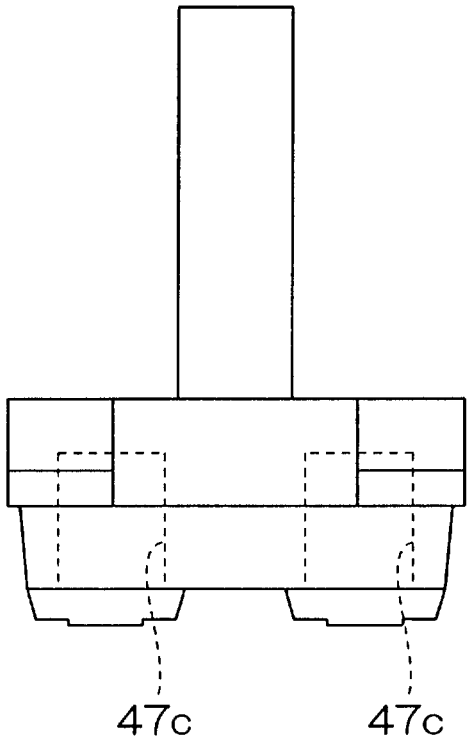
FIG. 5B is a side view illustrating the pushrod body shown in FIG. 5A.

As best shown in FIG. 5A, the pushrod 46 comprises a body 47 composed of a shaft portion 47*a* urged by the resilient force of the coil spring 34*a* in such a sense as to be extended from the housing bore 34*a* and a receptacle portion 47*b* generally rectangular in plan view connected to the lower end of the shaft portion 47*a*; a pair of axially extending housing bores 47*c*, 47*c* formed at a predetermined longitudinal spacing in the end face of the receptacle portion 47*b* as shown in FIG. 5B; and the first and the second thrust pieces 49*a* and 49*b* accommodated in the respective housing bores 47*c*, 47*c* through springs 48, 48 and urged by the springs 48, 48, respectively (the coil spring 48 and the associated thrust piece 49*b* housed in the other housing bore 47*c* are not visible in FIG. 5).

The spacing (center-to-center spacing) between the pair of housing bores 47*c*, 47*c* is set to be substantially equal to the spacing between the strip-like bodies 41*c* and 43*c* of the primary movable contact blade 41 and the secondary movable contact blade 43 disposed in parallel (to be exact, the center-to-center spacing between the strip-like bodies 41*c* and 43*c*), and the pushrod 46 is positioned such that the lower end receptacle portion 47*b* straddles the primary movable contact blade 41 and the secondary movable contact blade 43. With this arrangement, the first and second paired thrust pieces 49*a* and 49*b* are positioned so as to be in urged contact with the surfaces, respectively, of the strip-like bodies 41*c* and 43*c* of the primary movable contact blade 41 and the secondary movable contact blade 43 disposed in parallel. As previously noted, in this embodiment, the first thrust piece 49*a* is in urged contact with the surface of the strip-like body 41*c* of the primary movable contact blade 41 for sliding movement longitudinally of the strip-like body 41*c* as is readily appreciated from FIG. 2 while the second thrust piece 49*b* is in urged contact with the surface of the strip-like body 43*c* of the secondary movable contact blade 43 for sliding movement longitudinally of the strip-like body 43*c* as is readily appreciated from FIG. 3.

Further, it is to be noted that the thrust pieces 49*a*, 49*b* each comprise a hollow cylindrical member with its top end open and terminating in a conical tip and are each urged by the resilient force of a coil spring 48 housed in the hollow interior in the sense to be extended out of the respective housing bores 47*c*, 47*c*.

The pushrod 46 is assembled integrally with the lever 34 by means of the receptacle portion 47 being accommodated in the housing bore 34*a*, whereby it is insured that the first and second paired thrust pieces 49*a* and 49*b* are positioned so as to be in urged contact with the surfaces, respectively, of the strip-like bodies 41*c* and 43*c* of the primary movable contact blade 41 and the secondary movable contact blade 43 disposed in parallel and are adapted to slide on the surfaces of the strip-like body 41*c* and 43*c* as the lever 34 is rotatively moved. In addition, the force of this urged contact is provided by both the resilient force of the relatively large diameter coil spring 45 and the resilient force of the relatively small diameter coil spring 48, and on top of that, the two thrust pieces 49*a*, 49*b* have their own coil springs 48, whereby it is insured that the two thrust pieces 49*a* and 49*b* are urged into good contact with the surfaces, respectively, of the strip-like bodies 41*c* and 43*c* of the primary movable contact blade 41 and the secondary movable contact blade 43.

Next, the operation of the switch 51 constructed as described above will be explained with reference to FIGS. 6 and 7. Here, it is to be noted that FIG. 6 illustrates the movement on the side of the primary movable contact blade 41 concomitant with the operation of the lever 34 while FIG. 7 illustrates the movement on the side of the secondary movable contact blade 43 concomitant with the operation of the lever 34. Therefore, the primary movable contact blade 41 and the first neutral contact 35*c* supporting the primary movable contact blade 41 are not shown in the sectional view of FIG. 7.

Figure 6A:
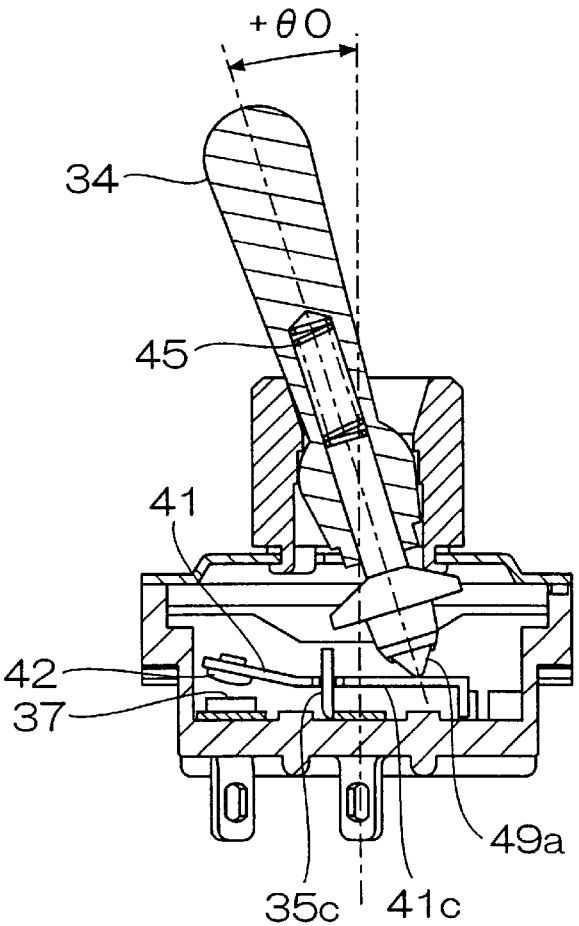
FIG. 6 is a diagrammatical sectional view illustrating the operation of primary movable contact blade of the switch shown in FIG. 2.
Figure 7A:
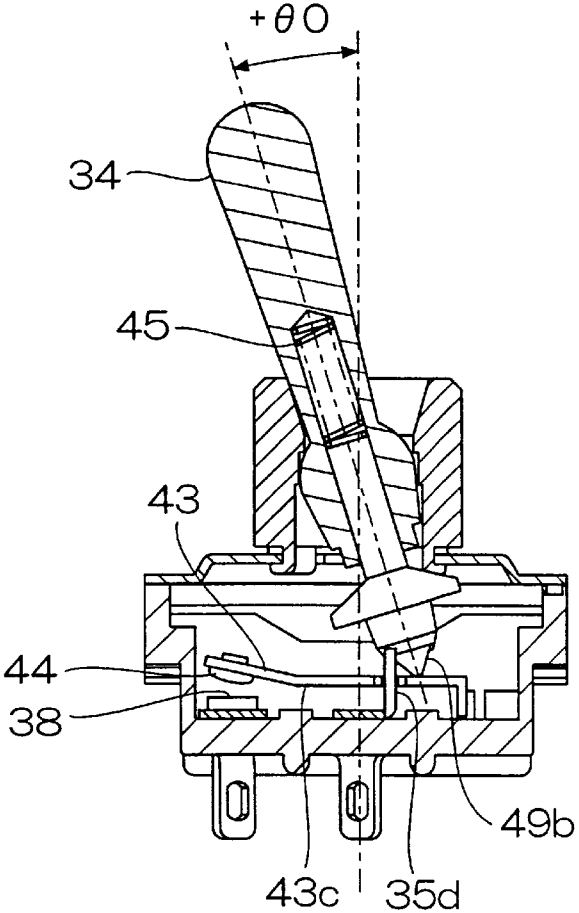
FIG. 7 is a diagrammatical sectional view illustrating the operation of the secondary movable contact blade of the switch shown in FIG. 3.

FIGS. 6A and 7A illustrate how the primary movable contact blade 41 is and how the secondary movable contact blade 43 is, respectively, when the lever 34 is moved to one tilted position (lever angle: +θ0) which corresponds to the switch-off position. In this position, the primary movable contact 42 is separated from the primary fixed contact 37, and likewise the secondary movable contact 44 is separated from the secondary fixed contact 38, so that the contacts 42 and 44 of the primary movable contact blade 41 and the secondary movable contact blade 43 respectively are both in their off-position.

Figure 7B:
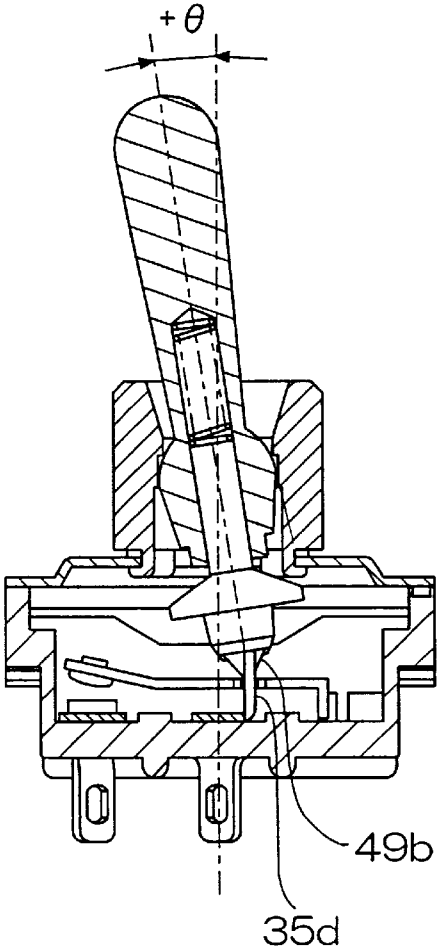

Then, when the lever 34 is maneuvered from the switch-off position (turned in a clockwise direction as viewed in the drawing) to an lever angle +θ, the second thrust piece 49*b* lies just on the second neutral contact 35*d* as shown in FIG. 7B. At this point of time, the first thrust piece 49*a* has not yet reached the first neutral contact 35*c*. With continued operation of the lever 34, and the instant that the second thrust piece 49*b* has passed over the second neutral contact 35*d*, the secondary movable contact blade 43 is moved through a seesaw motion to instantaneously bring the secondary movable contact 44 into contact with the secondary fixed contact 38, whereby the switch 51 is turned on.

Figure 6B:
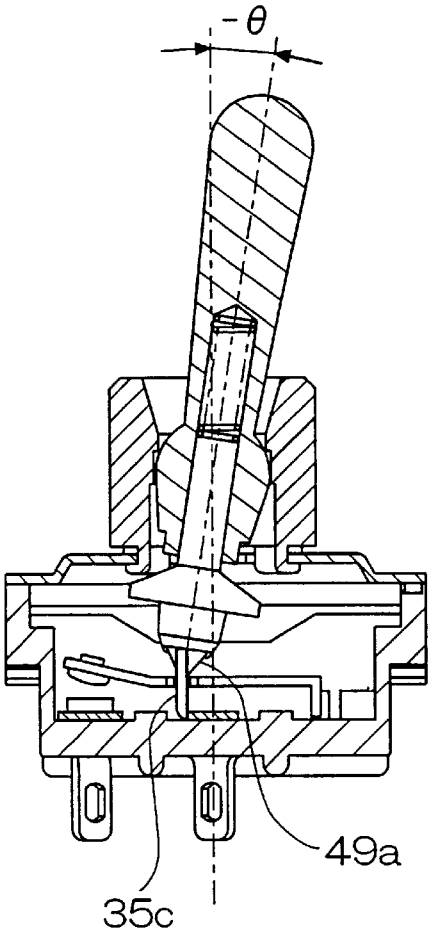

As the lever 34 is further operated to a lever angle −θ, the first thrust piece 49*a* in turn lies just on the first neutral contact 35*c* as shown in FIG. 6B. At this time, the secondary movable contact 44 is still maintained in contact with the secondary fixed contact 38. With further continued operation of the lever 34, and the instant that the first thrust piece 49*a* has passed over the first neutral contact 35*c*, the primary movable contact blade 41 is in turn moved through a seesaw motion to instantaneously bring the primary movable contact 42 into contact with the primary fixed contact 37. And the lever 34 is rapidly turned under the resilient forces of the coil springs 45 and 48 to reach the other tilted position (lever angle: −θ0) which corresponds to the switch-on position shown in FIGS. 6C and 7C. That is, the lever 34 is rapidly moved by snap action under the resilient forces of the coil springs 45 and 48 while the contact between the primary movable contact 42 and the primary fixed contact 37 and the contact between the secondary movable contact 44 and the secondary fixed contact 38 are maintained, whereby the switch 51 is maintained in its on state.

Figure 6C:
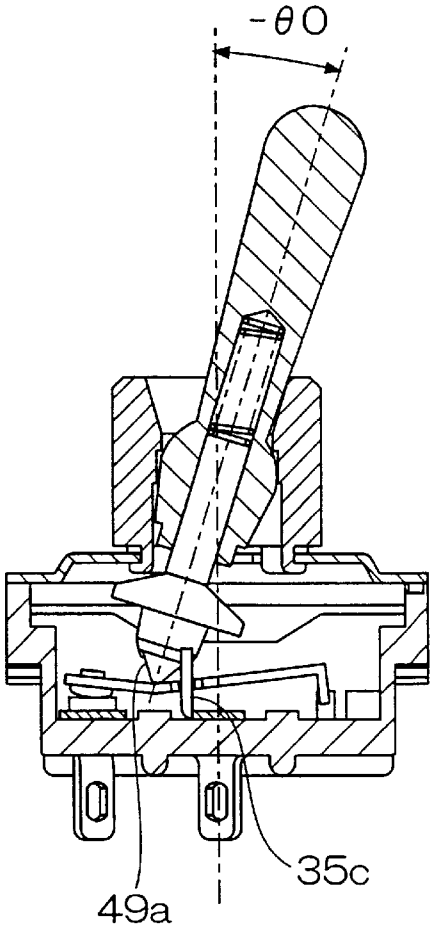
Figure 7C:
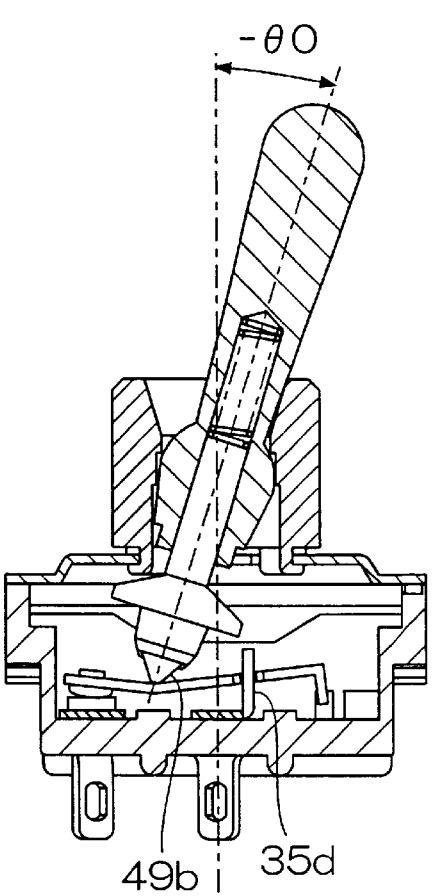

Conversely, as the lever 34 is rotatively moved in the counter-clockwise direction as viewed in the drawing from the switch-on position (lever angle: −θ0) shown in FIGS. 6C and 7C to the lever angle −θ, the first thrust piece 49*a* lies just on the first neutral contact 35*c* as shown in FIG. 6B. At this time, the contact between the primary movable contact 42 and the primary fixed contact 37 and the contact between the secondary movable contact 44 and the secondary fixed contact 38 are maintained. With continued operation of the lever 34, and the instant that the first thrust piece 49*a* has passed over the first neutral contact 35*c*, the primary movable contact blade 41 is moved through a seesaw motion to instantaneously separate or disconnect the primary movable contact 42 from the primary fixed contact 37. At this time, the contact between the secondary movable contact 44 and the secondary fixed contact 38 is still maintained.

With further continued operation of the lever 34, and the instant that the second thrust piece 49*b* has passed over the second neutral contact 35*d*, the secondary movable contact blade 43 is in turn moved through a seesaw motion to instantaneously separate or disconnect the secondary movable contact 44 from the secondary fixed contact 38. At the same time, the lever 34 is rapidly moved by snap action under the resilient forces of the coil springs 45 and 48 to the switch-off position (lever angle: +θ0) shown in FIGS. 6C and 7C. The switch 51 is thus maintained in its off state.

As explained above, the switch 51 constructed as described above is configured such that the secondary movable contact 44 of the secondary movable contact blade 43 has first contacted with the secondary fixed contact 38 of the fixed contact blade 36 prior to the primary movable contact 42 of the primary movable contact blade 41 contacting with the primary fixed contact 37 of the fixed contact blade 36 and that after the primary movable contact 42 of the primary movable contact blade 41 has been first separated or disconnected from the primary fixed contact 37 of the fixed contact blade 36, the secondary movable contact 44 of the secondary movable contact blade 43 is separated or disconnected from the secondary fixed contact 38 of the fixed contact blade 36. It will thus be appreciated that any large closing current flow associated with the switch-on operation and any arc discharge associated with the switch-off operation may occur mainly between the secondary movable contact 44 of the secondary movable contact blade 43 and the secondary fixed contact blade 36. In other words, the switch 51 constructed according to the first embodiment described above is configured such that neither flow of a large closing current associated with the switch-on operation nor arc discharge associated with the switch-off operation may occur between the primary movable contact 42 of the primary movable contact blade 41 and the primary fixed contact 37 of the fixed contact blade 36. Consequently, the primary movable contact 42 and the primary fixed contact 37 are not susceptible to either thermal deformation due to heating caused by the closing current or damage due to arc discharge, and thereby contribute to realizing a switch having a long contact life and a superior durability.

Mentioning an example of the numerical values for the angles of the operational positions of the lever 34 as shown in FIGS. 6 and 7, the lever angle $\theta 0=16.7°$ and $\theta=8.7°$. Further, in view of the operation and function as described above, it is preferable that the primary movable contact 42 of the primary movable contact blade 41 and the primary fixed contact 37 of the fixed contact blade 36 be made of silver, for example, whereas the secondary movable contact 44 of the secondary movable contact blade 43 and the secondary fixed contact 38 of the fixed contact blade 36 be made of silver-tungsten or the like having a high hardness and a high wear resistance. It is needless to say that gold or other good electrically conductive metals may be used for the primary movable contact 42 and the primary fixed contact 37 and that other high hardness and high wear resistant metals may be used for the secondary movable contact 44 and the secondary fixed contact 38.

In addition, the secondary movable contact 44 and the secondary fixed contact 38 may be greater in dimensions and thickness, for example, as compared to the primary movable contact 42 and the primary fixed contact 37.

Figure 8:
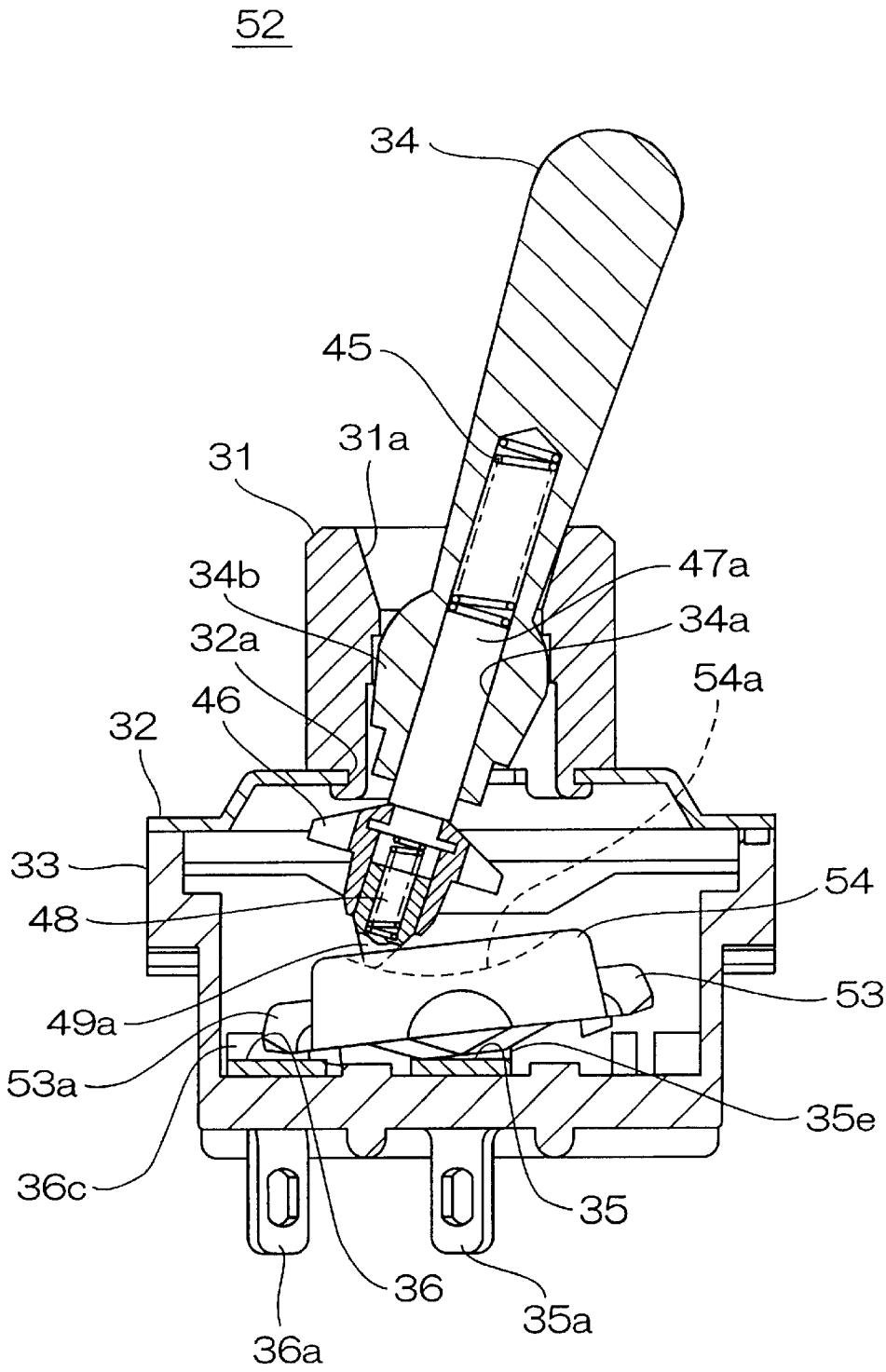
FIG. 8 is a diagrammatical sectional view illustrating the construction of the principal parts of a second embodiment of the switch according to the present invention.
Figure 9:
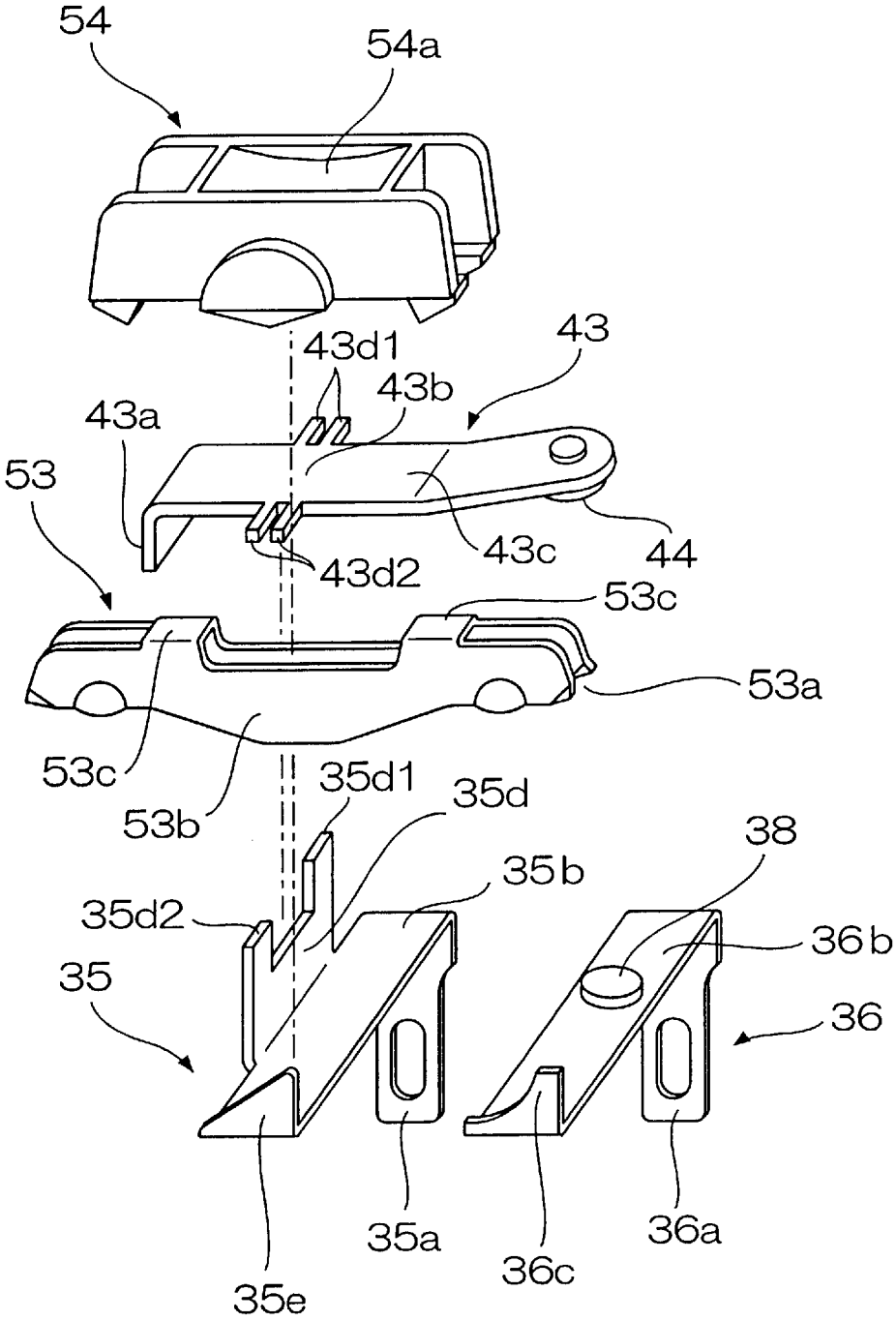
FIG. 9 is an exploded perspective view of the primary movable contact blade, the secondary movable contact blade, the holder, the neutral contact blade and the fixed contact blade as removed from the switch shown in FIG. 8.

FIG. 8 is a diagrammatical sectional view illustrating the construction of the principal parts of a second embodiment of the switch according to the present invention, and FIG. 9 is an exploded perspective view of a primary movable contact blade, a secondary movable contact blade, a holder, a neutral contact blade and a fixed contact blade as removed from the switch shown in FIG. 8. In the switch 52 of this second embodiment, a sleeve 31, a frame 32, a box 33, a lever 34, a coil spring 45, a pushrod or actuator 46, the secondary movable contact blade 43, a second neutral contact 35*d* of the neutral contact blade 35 bearing the secondary movable contact blade 43 for seesaw motion, and a secondary fixed contact 38 of the fixed contact blade 36 adapted to be contacted with a secondary movable contact 44 of the secondary movable contact blade 43 when the switch is turned on may be of the same geometry (shape and dimension or size) and construction as the corresponding components of the first embodiment, and accordingly they are designated by the same reference characters as those of the components or members in FIGS. 2 to 5 and will not be discussed again in detail, unless necessary.

The primary movable contact blade 53 is generally in the form of a clip as shown in FIG. 9 and comprises two face-to-face opposing elongate plate-like members having depending central portions 53*b*, the two plate-like members being spaced a predetermined distance apart and interconnected at their top edges by two web portions 53*c* at locations spaced oppositely but equidistantly from the center of the plate-like members. The top edges of those intermediate portions of the plate-like members extending between the two web portions 53*c* are recessed below the top edges of the rest of the plate-like members extending respectively outwardly from the web portions 53c. The central portions 53*b* have horizontal (flat) bottom edges, from the opposite ends of which the bottom edges of the rest of the plate-like members extend oppositely at a gradually upwardly inclined angle. That is, the two plate-like members are symmetrical about the vertical center line thereof. It is needless to say that the primary movable contact blade 53 may be of other shape than a clip.

The primary movable contact blade 53 is formed at its one end with a primary movable contact 53*a* which comprises two spaced apart blade contacts adapted to pinch or nip a generally mountain-shaped primary fixed contact 36*c* formed at one end of the fixed contact blade 36 therebetween in a clip-like manner thereby to electrically firmly contact with the primary fixed contact 36*c*.

The neutral contact blade 35 comprises a strip-like body 35*b* secured to the bottom surface of the box 33 generally in the center thereof and extending perpendicularly to the primary movable contact blade 53 and the secondary movable contact blade 43, a terminal 35*a* depending from the strip-like body 35*b* at one end thereof, a generally right-triangular first neutral contact 35*e* standing erect from the other end of the body 35*b* and terminating in an apex located toward one longitudinal side edge of the body 35*b*, and a generally U-shaped (channel-shaped) second neutral contact 35*d* standing erect from the other longitudinal side edge of the body 35*b* and having a cutout formed in its upper end in the center thereof to define two protrusions 35*d*1 and 35*d*2. It should be noted that the second neutral contact 35*d* is formed at a location spaced a predetermined distance from the first neutral contact 35*e* and on the other longitudinal side edge of the body 35*b* opposite from the side on which the apex of the first neutral contact 35*e* lies.

The fixed contact blade 36 comprises a strip-like body 36*b* secured to the internal bottom surface of the box 33 adjacent to one end portion (left-hand end as viewed in FIG. 8) thereof and extending perpendicularly to the primary movable contact blade 53 and the secondary movable contact blade 43, a terminal 36*a* depending from the body 36*b* at one end thereof, the generally mountain-shaped primary fixed contact 36*c* standing erect from the other end of the body 36*b* and terminating in an apex located toward one longitudinal side edge of the body 36*b*, and a secondary fixed contact 38 affixed to the surface of the body 36*b* at a predetermined location thereon.

Further, the terminals 35*a* and 36*a* depending from the one ends of the strip-like bodies 35*b* and 36*b* of the neutral contact blade 35 and the fixed contact blade 36, respectively, extend out through the bottom wall of the box 33 and are crimped to the box 33 by twisting the root portions of the respective terminals 35*a* and 36*a* in this embodiment to thereby secure the neutral contact blade 35 and the fixed contact blade 36 to the box 33.

The primary movable contact blade 53 constructed as described above is fitted into a holder 54 from below to be held thereby. The primary movable contact blade 53 thus held by and integrally assembled to the holder 54 is mounted on and supported by the first neutral contact 35*e* for seesaw motion with the two opposed central portions 53*b* pinching the first neutral contact 35*e* therebetween in a clip-like manner. It will be appreciated that the assembly of the thus integrally coupled primary movable contact blade 53 and holder 54 is supported by the first neutral contact 35*e* for seesaw motion about the apex of the neutral contact 35 e as its fulcrum while the primary movable contact blade 53 and the first neutral contact 35*e* are maintained in electrically firm contact.

The holder is provided on its top with a concave slideway 54*a* in the longitudinal direction thereof and the first thrust piece 49*a* of the pushrod 46 is adapted to slide on and along the concave slideway 54*a* as the lever 34 is operated (rotatively moved) while maintained in urged contact with the slideway 54*a* under the resilient forces of the coil springs 45 and 48.

The operation of the switch 52 constructed as described above according to the second embodiment will now be explained. When the lever 34 is rotatively moved from one tilted position (lever angle: +θ0) shown in FIGS. 6A and 7A which corresponds to the switch-off position to an lever angle +θ, the second thrust piece 49*b* lies just on the second neutral contact 35*d* as shown in FIG. 7B. At this point of time, the first thrust piece 49*a* has not yet reached the apex of the first neutral contact 35*e*. With continued operation of the lever 34, and the instant that the second thrust piece 49*b* has passed over the second neutral contact 35*d*, the secondary movable contact blade 43 is moved by the resilient forces of the coil springs 45 and 48 through a seesaw motion to instantaneously bring the secondary movable contact 44 into contact with the secondary fixed contact 38, whereby the switch 51 is turned on.

As the lever 34 is further operated to a lever angle −θ, the first thrust piece 49*a* in turn lies just on the first neutral contact 35*e* as shown in FIG. 6B. At this time, the contact between the secondary movable contact 44 and the secondary fixed contact 38 is maintained. With further continued operation of the lever 34, and the instant that the first thrust piece 49*a* has passed over the apex of the first neutral contact 35*e*, the primary movable contact blade 53/holder 54 assembly is in turn moved by the resilient forces of the coil springs 45 and 48 through a seesaw motion to instantaneously bring the primary movable contact 53*a* into contact with the primary fixed contact 36*c* with the blade contacts of the primary movable contact 53*a* nipping or pinching the primary fixed contact 36*c* therebetween in a clip-like manner. At the same time, the lever 34 is rapidly rotated to reach the other tilted position (lever angle: −θ0) which corresponds to the switch-on position shown in FIGS. 6C and 7C. That is, the lever 34 is rapidly moved by snap action under the resilient forces of the coil springs 45 and 48 while the contact between the primary movable contact 53*a* and the primary fixed contact 36*c* and the contact between the secondary movable contact 44 and the secondary fixed contact 38 are maintained, whereby the switch 52 is maintained in its on state. FIG. 8 shows this switch-on state in which the primary movable contact 53*a* is in electrical contact with the primary fixed contact 36*c* with the blade contacts of the primary movable contact 53*a* nipping the primary fixed contact 36*c* therebetween in a clip-like manner. While not shown in FIG. 8, it is to be understood that at this time the contact between the secondary movable contact 44 and the secondary fixed contact 38 remains maintained.

The switch 52 constructed as described above is configured such that the secondary movable contact 44 of the secondary movable contact blade 43 has first contacted with the secondary fixed contact 38 of the fixed contact blade 36 before the primary movable contact 53*a* of the primary movable contact blade 53 comes into contact with the primary fixed contact 36*c* of the fixed contact blade 36 and that after the primary movable contact 53*a* of the primary movable contact blade 53 has been first separated or disconnected from the primary fixed contact 36*c* of the fixed contact blade 36, the secondary movable contact 44 of the secondary movable contact blade 43 separates or disconnects from the secondary fixed contact 38 of the fixed contact blade 36. It will thus be appreciated that any large closing current flow associated with the switch-on operation and any arc discharge associated with the switch-off operation may occur mainly between the secondary movable contact 44 of the secondary movable contact blade 43 and the secondary fixed contact 38 of the fixed contact blade 36. In other words, the switch 52 constructed according to the second embodiment described above is configured such that neither flow of a large closing current associated with the switch-on operation nor arc discharge associated with the switch-off operation may occur between the primary movable contact 53*a* of the primary movable contact blade 53 and the primary fixed contact 36*c* of the fixed contact blade 36. Consequently, the primary movable contact 53*a* and the primary fixed contact 36*c* are not susceptible to either thermal deformation due to heating caused by the closing current or damage due to arc discharge, and thereby contribute to realizing a switch having a long contact life and a superior durability.

In addition, according to the second embodiment described above, the primary movable contact blade 53 is provided with the primary movable contact 53*a* comprising two blade contacts adapted to electrically contact with the primary fixed contact 36*c* by pinching it therebetween in a clip-like manner, whereby it provides the additional advantage, not achievable with the first embodiment, that the contact resistance may be reduced to a minimum. Moreover, it provides the still additional advantage, not achievable with the first embodiment, that the primary movable contact blade 53 is prevented from chattering when the primary movable contact blade 53/holder 54 assembly is moved through a seesaw motion under the resilient forces of the coil springs 45 and 48 to instantaneously contact the primary movable contact 53*a* with the primary fixed contact 36*c*, because there is involved no abutting impact between the contacts.

As is clearly appreciated from the foregoing, the present invention provides for extending the useful lives of both the primary movable contact of the primary movable contact blade and the primary fixed contact of the fixed contact blade which is repeatedly contacted with the primary movable contact on the basis of the on/off operation of the switch by providing the secondary movable contact blade in addition to the primary movable contact blade thereby to cause any large closing current flow associated with the switch-on operation and any arc discharge associated with the switch-off operation to occur mainly between the secondary movable contact of the secondary movable contact blade and the secondary fixed contact of the fixed contact blade. Thus, the invention can provide a switch having a long contact life and a superior durability.

In addition, in the case where the primary movable contact is composed of two blade contacts configured to pinch the primary fixed contact therebetween in a clip-like manner, the contact resistance may be reduced to a minimum, whereby an infinitesimal (a very little) current may be coped with. It will thus be appreciated that the present invention can provide a switch capable of utilizing in a wide current range from a minute current to a large current.

While the present invention has been described with regard to the preferred embodiments shown by way of example, it will be apparent to those skilled in the art that various modifications, alterations, changes, and/or minor improvements of the embodiments described above can be made without departing from the spirit and the scope of the present invention. Accordingly, it should be understood that the present invention is not limited to the illustrated embodiments, and is intended to encompass all such modifications, alterations, changes, and/or minor improvements falling within the scope of the invention defined by the appended claims.

What is claimed is:

1. A switch comprising:

a neutral contact blade provided with a first neutral contact and a second neutral contact;

a fixed contact blade provided with a primary fixed contact and a secondary fixed contact;

a primary movable contact blade supported by said first neutral contact for seesaw motion about the first neutral contact as a fulcrum and provided at one end thereof with a primary movable contact adapted to contact with and separate from said primary fixed contact;

a secondary movable contact blade supported by said second neutral contact for seesaw motion about the second neutral contact as a fulcrum and provided at one end thereof with a secondary movable contact adapted to contact with and separate from said secondary fixed contact; and a pushrod integrated with a lever and adapted to slide on said primary movable contact blade and on said secondary movable contact blade on the basis of throw-up and throw-down operation of said lever to cause the primary and the secondary movable contact blades to move in a seesaw motion;

whereby said secondary movable contact contacts with said secondary fixed contact before said primary movable contact contacts with said primary fixed contact, and said secondary movable contact is separated from said secondary fixed contact after said primary movable contact is separated from the primary fixed contact.

2. The switch as set forth in claim 1, wherein said primary movable contact blade comprises: a strip-like body; a folded portion depending from the body at one end thereof; a support portion including two opposed pairs of protrusions extending perpendicularly and generally horizontally from opposite longitudinal side edges of the body generally in the center thereof; and a primary movable contact affixed to the undersurface of the body adjacent to the other end thereof, and said secondary movable contact blade comprises: a strip-like body; a folded portion depending from the body at one end thereof; a support portion including two opposed pairs of protrusions extending perpendicularly and generally horizontally from opposite longitudinal side edges of the body toward the folded portion; and the secondary movable contact affixed to the undersurface of the body adjacent to the other end thereof, the support portion of said secondary movable contact blade being located closer to said folded portion by a distance approximately equal to the width of the body of said neutral contact blade than the support portion of said primary movable contact blade is;

said primary movable contact blade and said secondary movable contact blade being disposed in parallel with each other and supported by said first neutral contact and said second neutral contact, respectively, for seesaw motion thereabout.

3. The switch as set forth in claim 2, wherein said secondary movable contact and said secondary fixed contact are formed of silver-tungsten.

4. The switch as set forth in claim 1, wherein said primary movable contact blade includes a pair of blade-like supports adapted to nip therebetween said first neutral contact and a pair of blade-like primary movable contacts adapted to nip therebetween said primary fixed contact.

5. The switch as set forth in claim 4, wherein said secondary movable contact and said secondary fixed contact are formed of silver-tungsten.

6. The switch as set forth in claim 1, wherein said secondary movable contact and said secondary fixed contact are formed of silver-tungsten.

* * * * *